US006357945B1

(12) United States Patent
Losier et al.

(10) Patent No.: US 6,357,945 B1
(45) Date of Patent: Mar. 19, 2002

(54) COSMETIC DISPENSER

(75) Inventors: Donald P. Losier, Chester, NJ (US); John C. Crawford, Mahopac, NY (US); Van Canady, Princeton, NJ (US)

(73) Assignee: Colgate Palmolive Company, New York, NY (US)

( * ) Notice: Subject to any disclaimer, the term of this patent is extended or adjusted under 35 U.S.C. 154(b) by 0 days.

(21) Appl. No.: 09/427,332

(22) Filed: Oct. 26, 1999

Related U.S. Application Data

(63) Continuation-in-part of application No. 09/233,807, filed on Nov. 4, 1998, now abandoned, which is a continuation-in-part of application No. 09/168,144, filed on Oct. 7, 1998, now abandoned, and a continuation-in-part of application No. 29/082,390, filed on Jan. 21, 1998.

(51) Int. Cl.[7] ..... B43K 5/06

(52) U.S. Cl. ..... 401/175; 401/174; 401/172; 401/266; 401/265

(58) Field of Search ..... 401/175, 172, 401/173, 174, 265, 266, 202

(56) References Cited

U.S. PATENT DOCUMENTS

| | | | | |
|---|---|---|---|---|
| 519,051 A | | 5/1894 | Terry | |
| 555,763 A | | 3/1896 | Fessenden | |
| 1,968,686 A | | 7/1934 | Janer | |
| 2,557,221 A | | 6/1951 | Gazda | |
| 3,179,972 A | * | 4/1965 | Fillmore | 401/202 |
| 3,409,186 A | | 11/1968 | Melocchi | |
| D216,294 S | | 12/1969 | Rias | |
| 3,858,762 A | | 1/1975 | Meshberg | |
| D248,214 S | | 6/1978 | DiNuccio | |
| 4,138,039 A | | 2/1979 | Micallef | |
| 4,185,776 A | | 1/1980 | Nozawa | |
| 4,225,254 A | | 9/1980 | Holberg et al. | |
| 4,333,589 A | | 6/1982 | Bush | |
| 4,348,126 A | * | 9/1982 | Nigro | 401/175 |
| 4,353,956 A | | 10/1982 | Nalle | |
| 4,492,223 A | | 1/1985 | Burke | |
| 4,567,011 A | | 1/1986 | Nalle | |
| 4,571,106 A | | 2/1986 | Scuderi | |
| D285,172 S | | 8/1986 | Scuderi | |
| 4,801,052 A | | 1/1989 | Citterio | |
| 4,842,794 A | | 6/1989 | Hovis et al. | |
| 4,865,231 A | | 9/1989 | Wiercinski | |
| D308,330 S | | 6/1990 | Teece | |
| D308,476 S | | 6/1990 | Rosenberg | |
| 4,931,484 A | | 6/1990 | Hovis et al. | |

(List continued on next page.)

FOREIGN PATENT DOCUMENTS

| | | |
|---|---|---|
| DE | 34 02 614 A1 | 8/1985 |
| EP | 310 448 A | 4/1989 |
| IT | 457629 | 5/1950 |
| SE | 82697 | 2/1935 |

*Primary Examiner*—David J. Walczak
(74) *Attorney, Agent, or Firm*—Michael J. McGreal

(57) ABSTRACT

The dispenser is of an ergonomic shape, provides for single hand use in the actuation of the dispenser and the application of substances to the skin, and can accommodate different application surfaces. The dispenser has a barrel closed at one end and an angled barrel extension at another end. The push button actuator to dispense the product is located in the barrel extension. On the upper end of the barrel extension is an applicator surface. This applicator surface can be microporous, porous or have separate distinct apertures. A gel, lotion or other semisolid liquid is stored in the barrel. Upon pressing the actuator the elevator rises upwardly with the gel, lotion or other semisolid liquid passing through conduits to the applicator surface. It then is applied to the skin. The pressing of the actuator causes a threaded rod to rotate which raises the elevational. By placing the actuator at a mid to upper part of the dispenser, the dispenser can be gripped with the thumb on the actuator and the other fingers passing behind the barrel of gripping. The actuator can be operated without changing the position of the dispenser in the hand

13 Claims, 6 Drawing Sheets

U.S. PATENT DOCUMENTS 4,961,661 A 10/1990 Sutton et al.
5,007,754 A * 4/1991 Zierhut ..... 401/174
5,088,849 A 2/1992 Johnson et al.
5,092,468 A 3/1992 Slocumb
5,098,782 A 3/1992 Hovis et al.
5,111,972 A 5/1992 Sakurai et al.
5,139,180 A 8/1992 Lucas
D332,914 S 2/1993 Stephens
D333,191 S 2/1993 Rainen
D334,712 S 4/1993 Turner-Adams
5,207,962 A 5/1993 Hovis et al.
5,234,136 A 8/1993 Kopis
D340,865 S 11/1993 Endre
5,277,515 A 1/1994 Hovis et al.
5,308,182 A 5/1994 Lampert
5,320,259 A 6/1994 Weinstein
5,372,285 A 12/1994 Harrold et al.
5,460,878 A 10/1995 Hostetter
5,489,437 A 2/1996 Marra
5,540,361 A 7/1996 Fattori
5,547,302 A 8/1996 Dornbusch
5,570,821 A 11/1996 DeJonge
5,573,341 A 11/1996 Iaia
5,725,133 A 3/1998 Iaia
5,772,347 A 6/1998 Gueret
5,839,622 A 11/1998 Bicknell et al.
5,860,572 A 1/1999 Harrold et al.

COSMETIC DISPENSER

This is a continuation-in-part application under 35 U.S.C. 111 and 37 CFR 1.53(b) of prior applications U.S. Ser. No. 09/233,807 filed Nov. 4, 1998, now abandoned which is a continuation-in-part application of U.S. Ser. No. 09/168,144 filed on Oct. 7, 1998, now abandoned entitled Applicator For Flowable Substances and U.S. Design application Ser. No. 29/082,390 filed Jan. 21, 1998 entitled Dispenser, all of which applications are incorporated herein by reference.

FIELD OF THE INVENTION

The present invention relates to a cosmetic dispenser that has improved ergonomic characteristics and which is easier to operate. More particularly, this invention relates to a cosmetic dispenser that has an upper application portion that is at an angle to the lower handle portion and which has an actuator that is located adjacent the angled applicator portion.

BACKGROUND OF THE INVENTION

Cosmetic dispensers which include dispensers for deodorants, antiperspirants, lipstick, lip balm, mascara and related products have a generally linear form. These dispensers range from round, to oval, to having a rectangular contour. In the deodorant/antiperspirant area the dispensers presently are oval in shape or have a rectangular contour. Illustrative of such dispensers are the dispensers of U.S. Pat. No. 5,275,496, U.S. Pat. No. 5,753,212 and U.S. Design Pat. No. 379,927. These are very useful dispensers and provide ease in the application of the deodorant/antiperspirant product. However, there is a continuing need for dispensers that are easier to hold and to use.

The problem is to improve the ergonomics of the dispenser. Also, it is desired to improve the application of the contained product onto a person's skin. This entails the structure of the applicator surface of the dispenser and the shape of this applicator surface. Further, in the ejection of the contained product there is a need to improve the location of the dispenser actuator to improve the ergonomics of the dispenser. In particular, it would be useful to have single hand actuation of the dispenser during use in contrast to two hand actuation and then a subsequent use. Present dispensers require a holding in one hand and a rotating of a knob at the bottom of the dispenser, or the pressing of an actuator button at the bottom of the dispenser by the other hand. This is not a highly desirable way to use an applicator.

The present dispenser solves these and other problems. It has improved ergonomics. It is easier to hold . The applicator surface is at an angle to the dispenser body improving ease of use. The applicator surface is of an improved structure. Further, the dispenser actuator is moved to a point intermediate the ends thereby providing for single hand use. The dispenser can be actuated by a person's thumb while being gripped by the other four fingers. A person's thumb can rotate a knob or depress an actuator.

BRIEF SUMMARY OF THE INVENTION

The present invention is directed to a cosmetic dispenser that has improved ergonomics. The dispenser is easier to hold, to actuate and to apply a cosmetic product to a person's skin. The dispenser comprises a barrel of a generally oval shape. Extending upwardly from the barrel, and at an angle from the vertical (longitudinal) axis of the barrel is an applicator. The cosmetic product to be dispensed is stored in the barrel and dispensed onto a person's skin by the applicator.

Intermediate to the ends of the dispenser there is an actuator. The actuator upon being depressed or rotated causes the product contained in the barrel to be dispensed. In a preferred embodiment the actuator is located at about the junction of the barrel and the applicator. At this location the dispenser can be gripped with four fingers around the barrel and with the thumb available to rotate or depress the actuator.

The applicator surface for applying a cosmetic product such as a deodorant or antiperspirant onto one's skin can have various structures and shapes. The shape can be oval, a rectangular contour, generally triangular or of many other shapes. The surface of the applicator can be microporous to generally porous to a series of apertures of a relatively large diameter. A microporous structure can be a microporous polymer. A generally porous structure can be a woven or nonwoven mesh fabric. A nonwoven mesh fabric can be an extruded material with a plurality of apertures or can be a layer of random arrayed fibers. Regardless of the applicator surface, the dispenser shape provides for an added ease of handling.

DETAILED DESCRIPTION OF THE INVENTION

The cosmetic dispensers of the present invention have a new ergonomic shape for ease in gripping, actuation and use. This includes having the actuator in an upper part of the dispenser rather than at the base of the dispenser. In this way the dispenser can be held in one hand and actuated and used without changing the position in the hand. With the actuator at an upper part of the dispenser, the thumb can actuate the dispenser while also gripping the dispenser. The remaining four fingers traverse the rear surface of the dispenser and form the other part of the grip. The dispenser is gripped between the thumb and the remaining four fingers. The angled structure of the dispenser makes it easier to apply the contained products to the underarm area and other body areas.

Figure 1:
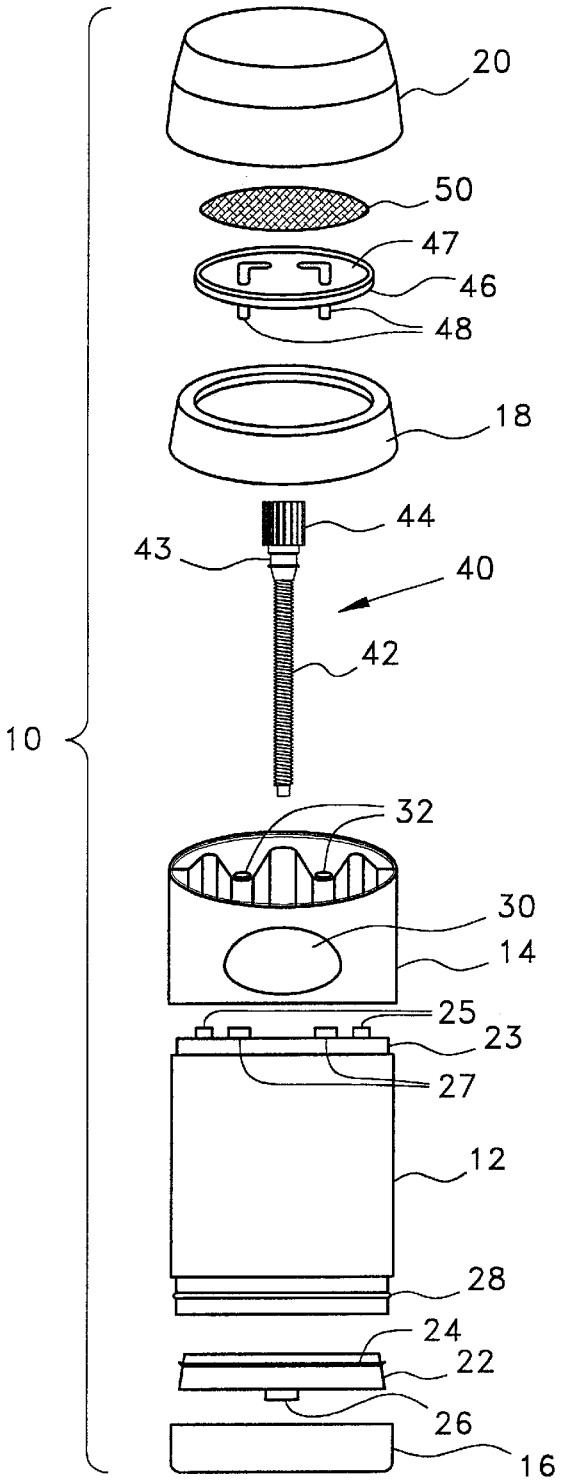
FIG. 1 is a front exploded view of the cosmetic dispenser of the present invention.

FIG. 1 is a front exploded view of the cosmetic dispenser 10. The cosmetic dispenser, which is particularly adapted for the application deodorants and antiperspirants, is comprised of the main parts of a barrel 12, barrel extension 14, applicator 18 and closure 20. The barrel 12 is closed by lower cover 16 which is held onto the barrel as a snap fit over ridge 11. The piston elevator 22, i.e. viscous liquid holder, rides in barrel 12 with the cosmetic material to be dispensed located above this piston elevator. In this view the piston elevator has a sealing ring 24. This sealing ring prevents the cosmetic material from flowing downwardly around the piston elevator.

On the upper part of the barrel are conduits 27 for flowing the cosmetic up into the conduits 32 in the barrel extension. Tabs 25 are guide tabs for aligning the barrel and the barrel extension. The barrel extension has the actuator for rotating the rod 40 which has a lower threaded screw 42 and an upper gear 44. The recess area 43 is for rotatably locking the rod 40 in barrel extension 14. The lower threaded portion 42 is threaded onto piston elevator 22 through threaded orifice 26.

The applicator 18 holds the distributor 46. The cosmetic flows from conduits 32 into conduits 48 in the distributor to the distributor top surface 47. Closing the top surface of the distributor is applicator surface 50. The applicator surface can be a microporous material to a porous mesh fabric material. The applicator is closed by closure 20.

Figure 2:
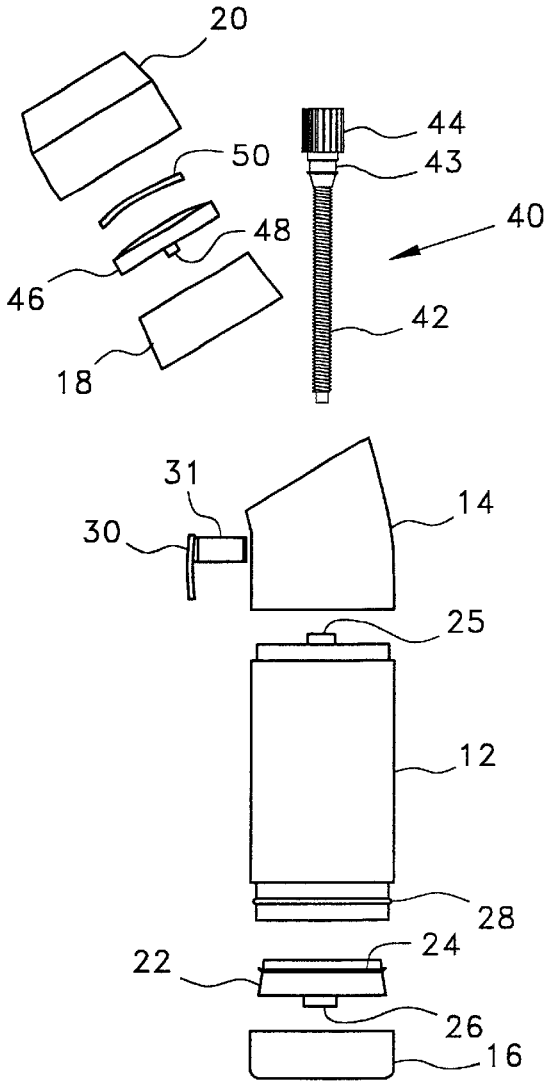
FIG. 2 is a side exploded view of the dispenser of FIG. 1.

FIG. 2 shows a side exploded view of the dispenser of FIG. 1 This view shows the same parts of FIG. 1 but with the actuator shown in more detail. The actuator has an inwardly extending leaf spring 31. The barrel 12 has closure 16 at one end and barrel extension 14 at the other end. Piston elevator 22 rides in barrel 12 and responds to the rotation of rod 40 upon which it is threaded. The actuator 30 rotates gear 44 of the rod which raises the piston elevator to dispense product into distributor 46 and through the applicator surface 50.

Figure 3:
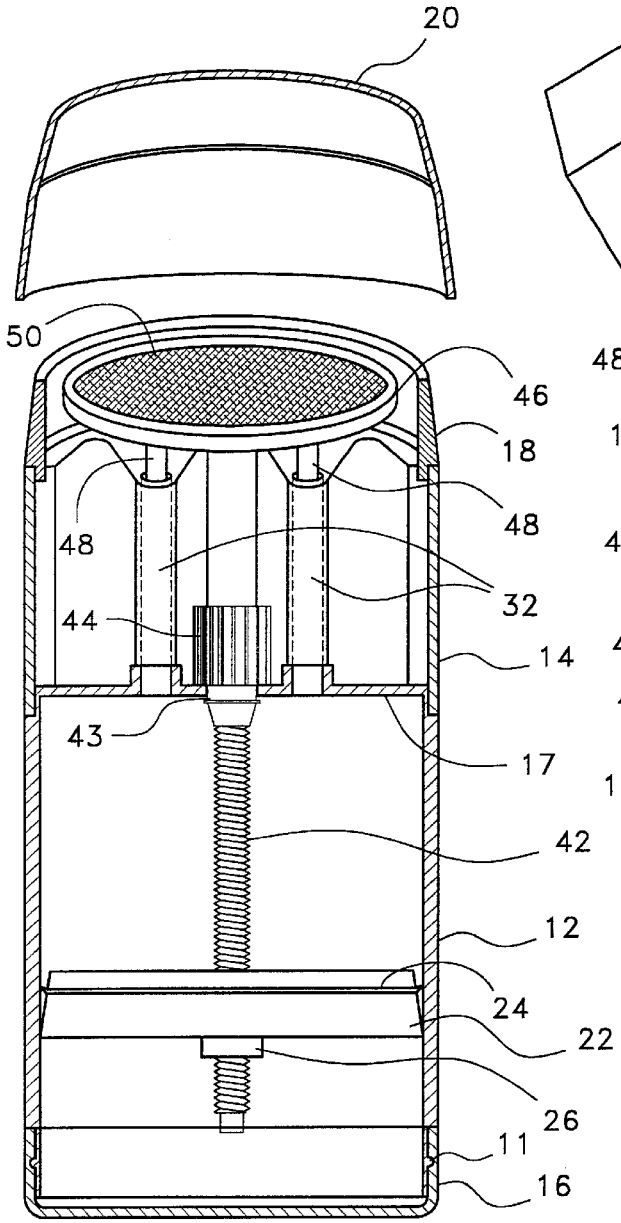
FIG. 3 is a front-sectional view of the cosmetic dispenser of FIG. 1 with the front wall removed.
Figure 4:
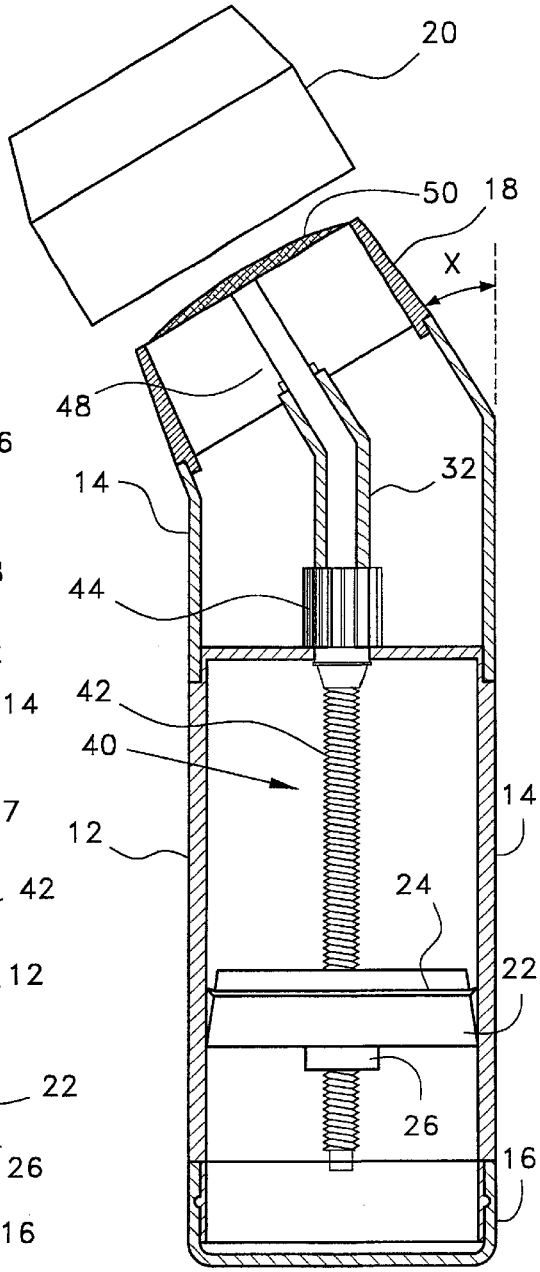
FIG. 4 is a side-sectional view of the cosmetic dispenser of FIG. 1 with the side wall removed.

FIG. 3 is a cross-sectional view of the assembled dispenser along a plane parallel to the major axis of the dispenser. The cap 16 is snap fitted onto the barrel 12 at ridge 11. The barrel extension is snap fitted onto the top of the barrel. The rod 40 is shown in a rotatable relationship with upper wall 17 of the barrel. Conduits 32 will flow cosmetic material from the interior of barrel 12 upon rotation of rod 40 and the upward movement of the piston elevator to interfitting conduits 48 of the distributor. The cosmetic material passes up to the surface below applicator surface 50. This structure is shown in FIG. 4 in a cross-sectional view of the assembled dispenser in a plane parallel to the minor axis. The parts have been described with regard to the prior figures. Additionally, in this view the angle of the dispenser is shown in more detail and the angle x is an angle of about 5° to 75° and preferably about 10° to 50° to the vertical, i.e. longitudinal, axis of the barrel.

Figure 5:
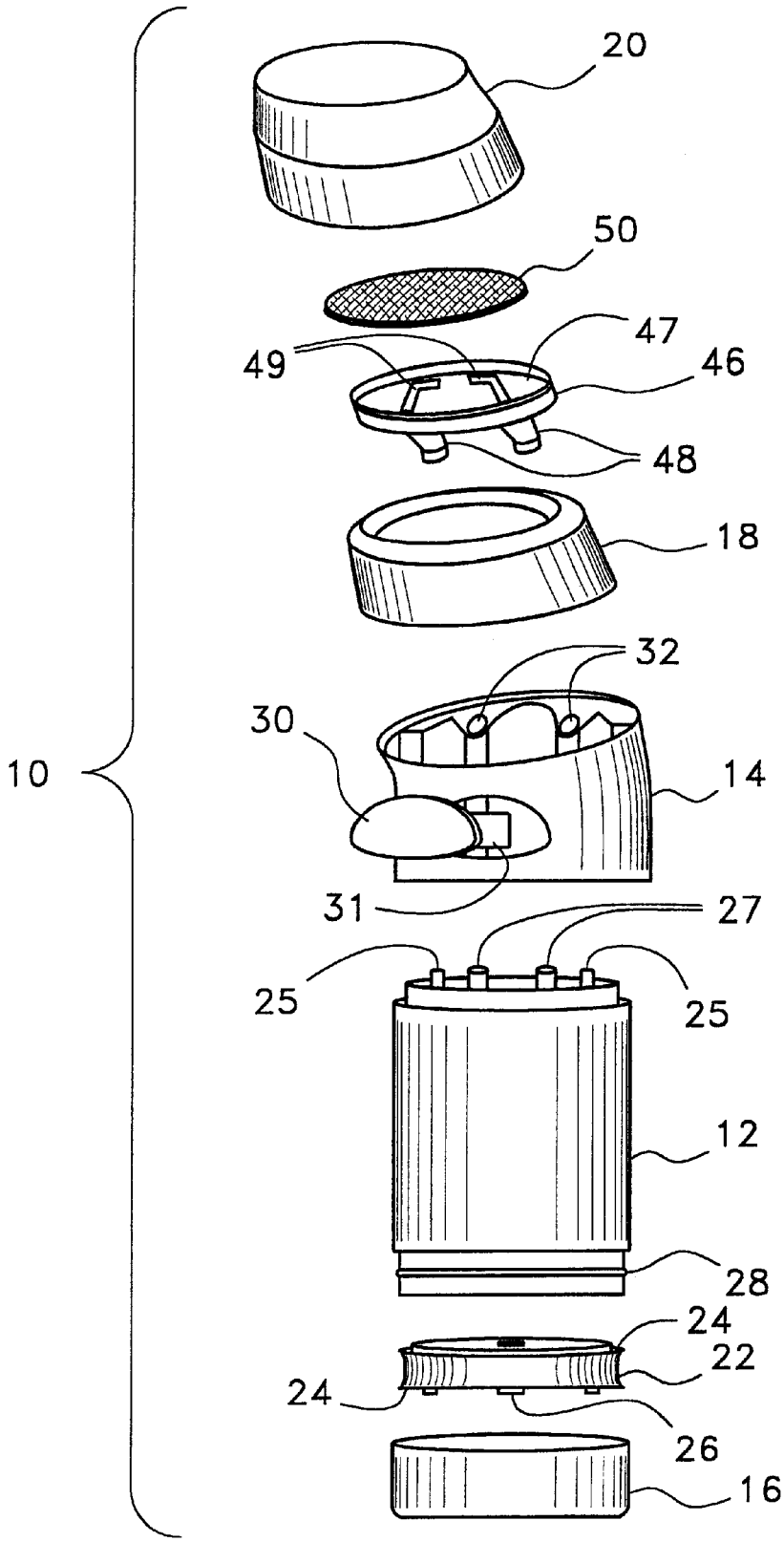
FIG. 5 is an exploded perspective view of the dispenser of FIG. 1.

FIG. 5 is an exploded perspective view of the dispenser. This view shows an alternative embodiment for the piston elevator and for the distributor. The piston elevator is shown with two piston seals 24. There is an upper and lower seal with a concave region between these two seals. The distributor is shown with two distribution channels 49.

Figure 6:
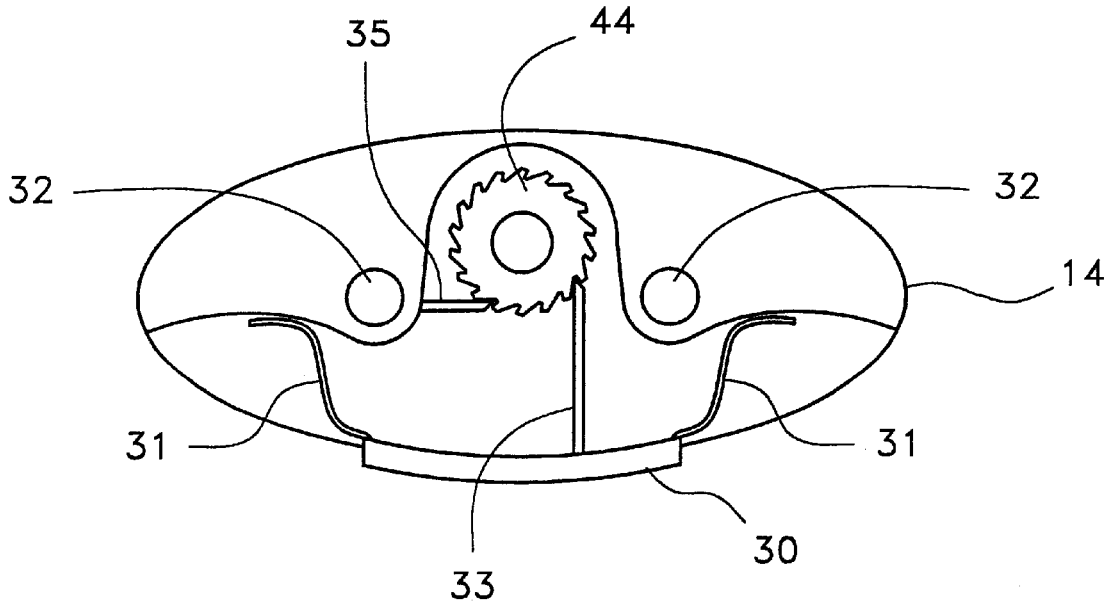
FIG. 6 is a top plan view of the barrel extension of the applicator of FIG. 1.

FIG. 6 is a top plan view of the cosmetic dispenser of FIG. 1 showing the actuator assembly. The actuator assembly is comprised of the actuator 30 with a leaf spring 31 extending from each end of the actuator. A drive arm 33 extends from the actuator and contacts gear 44 of rod 40. When the button is depressed, the drive rod moves the gear counterclockwise which moves the threaded piston elevator upward. The locking rod 35 prevents the gear 44 from reversing and backing off. After the actuator has been depressed the leaf springs 31 return the actuator to its original position.

Figure 7:
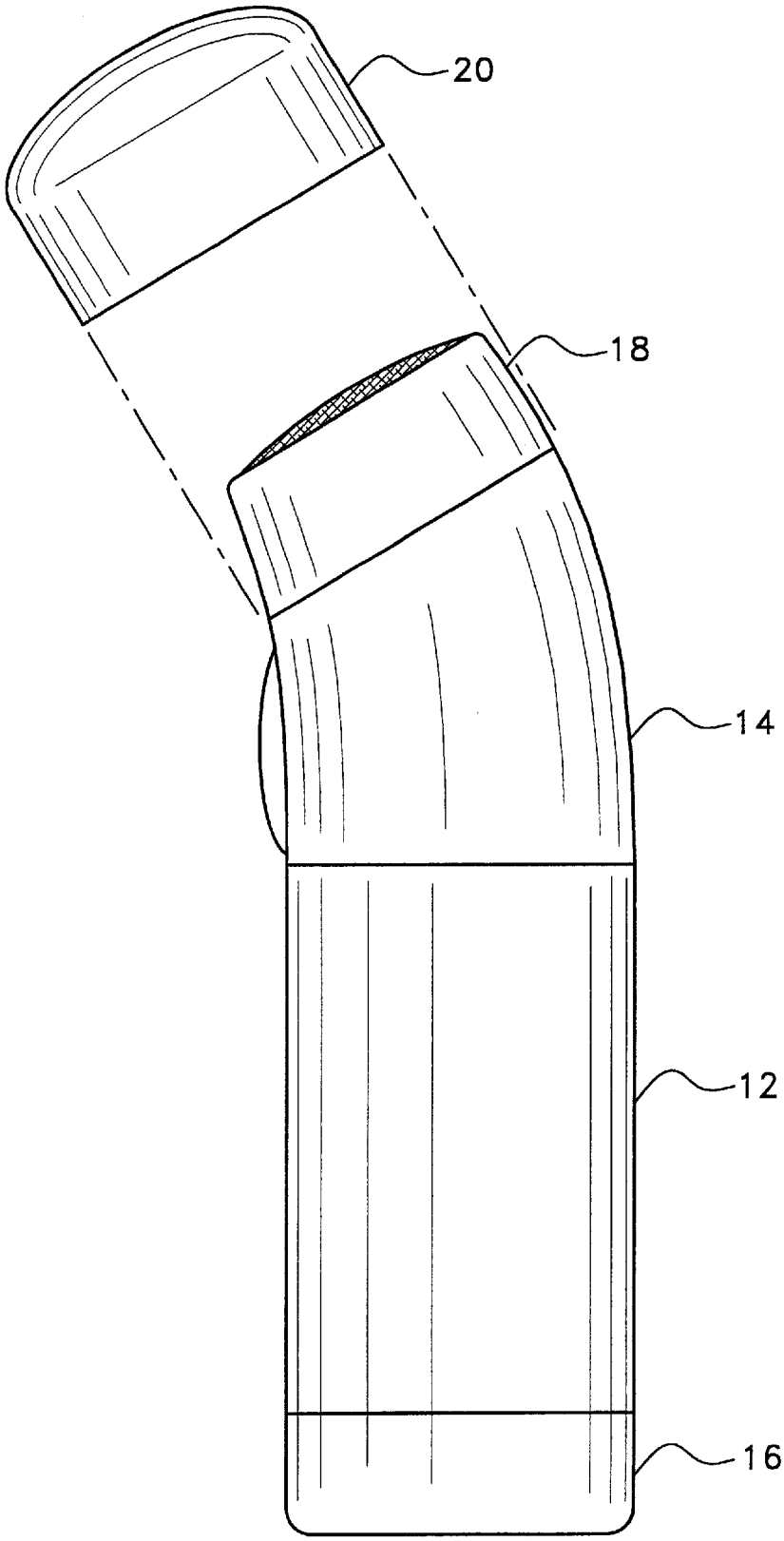
FIG. 7 is a side elevational view of the dispenser.

FIG. 7 is a side elevational view of the dispenser fully assembled. By grasping the barrel 12 with the thumb on the front adjacent the actuator on the barrel extension and the other four fingers on the rear surface of the barrel, the dispenser can be handled and used using a single hand. The shape of the dispenser and the location of the actuator provides for improved ergonomics for the dispenser.

Figure 8:
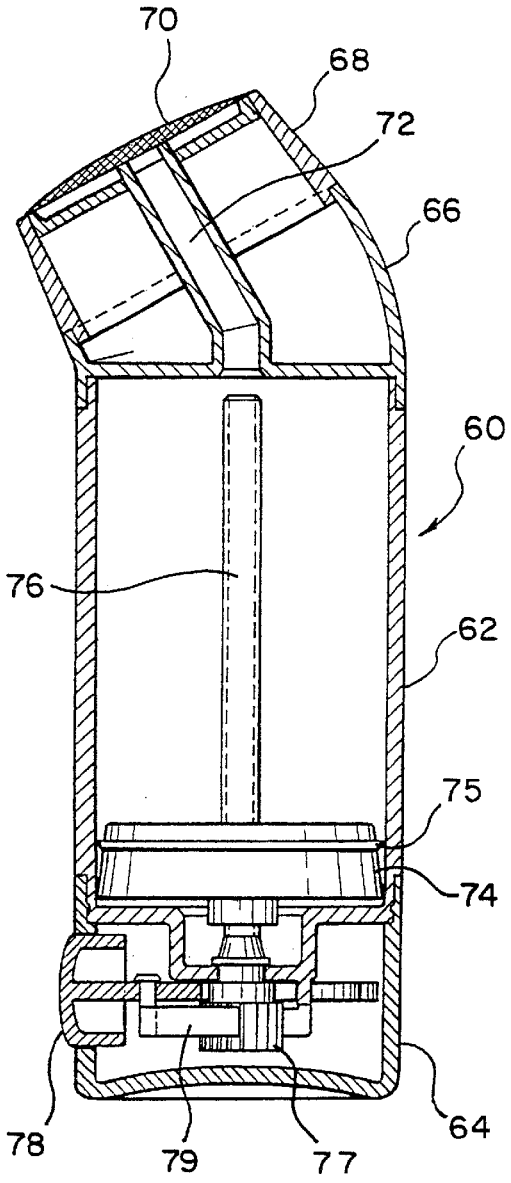
FIG. 8 is a side elevational view in cross-section of an embodiment of the dispenser with an actuator at a lower portion.

In FIG. 8 there is the embodiment of the dispenser with the actuator mechanism located at the base of the dispenser unit rather than in the region of angle. Dispenser 60 has a barrel 62 for containing the cosmetic to be dispensed. The lower section 64 contains the actuator mechanism to raise piston elevator 74, i.e. viscous liquid holder, to dispense the product contained in the barrel. The barrel 62 is closed on the upper end by angled barrel extension 66. An applicator surface 70, such as a dispensing screen is mounted onto the applicator section 68. The product flows to the applicator section 68 by means of conduit 72. There can be more than one conduit.

The product in barrel 62 is flowed through conduit 72 when piston elevator 74 is raised upwardly on threaded rod 76. The rotation of threaded rod 76 causes threadedly engaged piston elevator 74 to move upwardly on threaded rod 76 . A seal ring 75 provides a seal of the piston elevator to the barrel 62 .

The threaded rod 76 is rotated by means of actuator button 78. When the actuator button is depressed drive rod 79 contacts gear 77, rotating this gear, and thus, rod 76 which is connected to this gear. The angle of the barrel extension 66 aids in the application of a product to a skin surface. This angle can be the same as or similar to that of the dispenser of FIG. 1.

Figure 9:
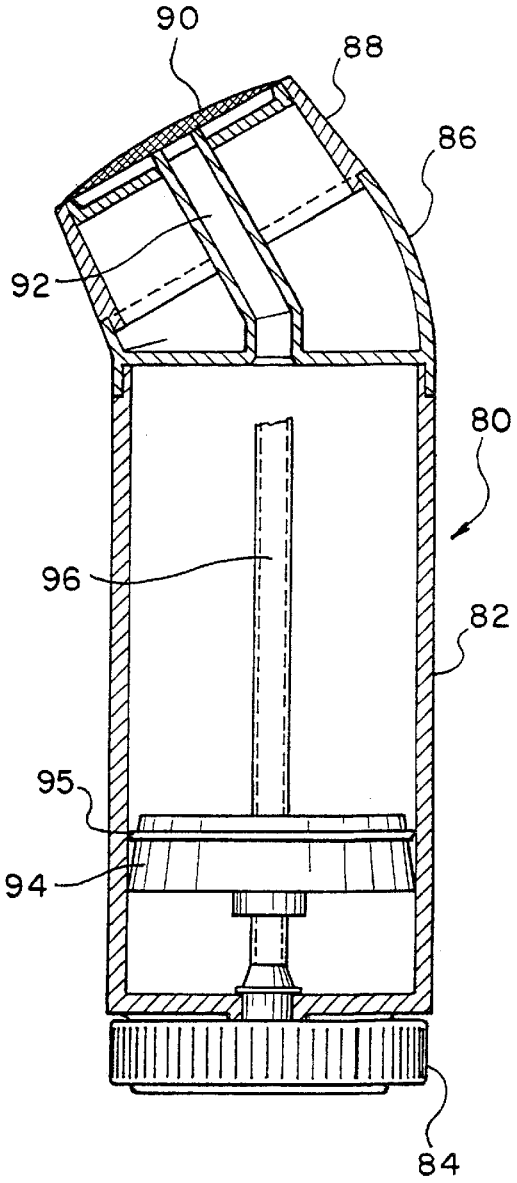
FIG. 9 is a side elevational view in cross-section of an embodiment of the dispenser with a rotating knob actuator.

In FIG. 9 there is shown a further embodiment of the dispenser. In this embodiment the dispensing of product is by means of rotating an actuator knob in the base of the dispenser. The dispenser 80 has barrel 82, angled barrel extension 86 and applicator 88 which has an applicator screen 90. The product to be dispensed flows from barrel 82 through conduit 92 to the applicator and screen 90. Located in barrel 82 is piston elevator 94, i.e. the viscous liquid holder. The piston elevator is sealed in barrel 82 by means of seal ring 95 on piston elevator 94. The piston elevator threadedly engages threaded rod 96 which is rotated by means of knob 84. Upon the rotation of knob 84 threaded rod 96 rotates and piston elevator 94 rises in barrel 82. The product in barrel 82 then flows through conduit 92 to the screen 90 whereupon it can be applied to a surface, such as a skin surface. The angle of the barrel extension will be the same as or similar to that of the dispenser of FIG. 1.

The applicator surfaces 50, 70 and 90 of the dispenser applicator 18 can be a microporous material through to porous mesh materials. A typical porous material can be a material that is marketed under the Porex® trademark. This is a microporous material of random interconnecting channels of a varying pore diameter. It is a porous polyene that usually is molded in the form in which it is to be used. The porous materials will be a woven or nonwoven fabric. The nonwoven fabrics can be a layer of randomly arrayed fibers or it can be an extruded film with apertures of a given size and array.

If a woven fabric the fabric can be of any of the three basic weaves. These are the plain, twill or satin weaves. If a plain weave this can be a regular plain weave, oxford weave, lousine weave, 2×2 basket weave, 3×2 basket weave, 3×3 basket weave, 4×4 basket weave, 4×5 basket weave, 3×5 basket weave and an 8×8 basket weave. In addition the fabric can be of a rip stop parachute type. In this type of weave there is an intermittent weave to stop any rips in the fabric. The twill fabrics can be a 2/1 right hand twill, a 1/2 right hand twill, a 2/2 right hand twill, a 3/1 right hand twill, a 3/1 45° right hand twill. The satin fabrics can be a 4 harness satin (i.e. crowfoot), 5 harness satin, 6 harness satin, a 7 harness satin or an 8 harness satin. These are all forms in which the fibers are interlaced in the warp and fill directions. The warp threads usually are called ends while the filling threads are called picks. The edges of the fabric are the selvage.

The construction of a woven fabric is given as ends x picks per inch. The weave can be balanced where there is the same number of threads in the warp direction and in the filling direction. In an unbalanced weave there will be more threads either in the warp direction or in the filling direction.

The tightness for a fabric can be calculated by the formula:

$$\text{Weave Texture} = \frac{\text{ends per repeat}}{\text{inch per repeat} + \text{interlacings}}$$

This same formula can be used to calculate the maximum cover for a fabric.

Also of importance is the denier of the threads. Denier is the weight in grams for 9000 meters of a thread. A low denier indicates a fine, relatively narrow cross-section thread. A higher specific gravity material at a given denier will have a smaller cross-section than a lower specific gravity material at that same denier.

There are many variables in the selection of a woven fabric. By the selection of the weave style, fabric tightness, fiber material, fiber structure and fiber denier, the texture of the fabric can be changed. The skin feel can range from smooth to rough. By calendaring or similarly treating the fabric, the surface of the fabric can be modified to produce a smoother texture and skin feel. The skin feel and the application also can be adjusted by the tension on the fabric in its attachment to the applicator frame. The flexibility of the fabric can be modified. Also, the fabric can be supported or unsupported. If supported, it can be supported along the major axis and/or along the minor axis, assuming the usual oval shape of an applicator surface. If the applicator is round, it can be supported by means of one or more diametric supports.

If the fabric is non-woven, it can be an extruded film that by its structure is porous, or is a solid film which is perforated to make it porous. In addition, a non-woven fabric can be comprised of a plurality of short length fibers that are laid down in a random array and then selectively bonded together adhesively or by heat bonding. The former extruded apertured films can be produced by the processes disclosed in U.S. Pat. No. 4,842,794 or U.S. Pat. No. 5,207,962. In U.S. Pat. No. 4,842,794 a sheet of thermoplastic film is extruded to a thickness of about 0.5 to 20 mils. One side of the film is provided with about 4 to 60 grooves per centimeter and the other side a set of grooves at an acute angle of 15° and 75° . The embossing rolls that have the patterns are at a pressure of about 4 to 120 pounds per linear centimeter. The result is a film with oval apertures. The film then can be uniaxially oriented in the machine or cross direction from about 50% to 500%, or sequentially biaxially oriented in the machine direction and cross direction up to about 600%. In the alternative the extruded and apertured film can be heat treated to increase the size of the apertures.

In the processes of U.S. Pat. No. 5,207,962 a thermoplastic film is extruded with the extruded film passed between a patterned nip roll and a smooth roll. The patterned nip roll has a plurality of raised projections with a sharp distal end. These sharp raised projections from the apertures in the film. The apertured film then can be uniaxially oriented in the machine or cross direction or biaxially oriented in both the machine direction and cross direction. The apertures will be of the shape and size of the distal end of the raised projections. The apertures also will be in a consistent repeating pattern. These extruded films are a class of non-woven fabrics for the purposes of this invention.

The extruded film also can be produced in the form of a sheet or in a plurality of strands. When extruded in the form of strands, these strands are in a sheet in a helical type of pattern. This also is known as a biplanar netting. The film that is produced in the form of helical strands can have 7 to 40 strands per 2.54 cm, be in a width of 30.48 cm to 152.4 cm and a thickness of 0.033 cm to 0.20 cm. The apertures can be in a size range of 100 to 500 micron and larger. The open area of the extruded strand type film can range from about 4% to 25% or more. Larger openings will provide a greater open area. Useful non-woven netting products are the Naltex®) products of Nalle Plastics, Inc.

The other parts of the cosmetic dispenser can be made using any injection moldable plastics. The preferred plastics are polyenes such as polyethylene and polypropylene and ABS (alkylbutylstyrene) polymers. Injection molding is a relatively inexpensive process and the polyene and ABS polymers are likewise of a relatively low cost.

What is claimed is:

1. A dispenser for a viscous liquid comprising:

a barrel containing said viscous liquid, said barrel closed at a first end and substantially closed at a second end;

a barrel extension on said second end of said barrel;

a viscous liquid holder in said barrel and moveably connected to a rod, an upper end of said rod extending into said barrel extension and having part of a mechanism for rotating said rod attached thereto;

an actuator extending from an exterior surface of said barrel extension into contact with part of said mechanism for rotating said rod;

a viscous liquid applicator at an upper portion of said barrel extension opposite said barrel, at least one conduit extending through said barrel extension connecting said barrel to a lower portion of said viscous liquid applicator, said viscous liquid applicator having a surface on an upper portion for the delivery of said viscous liquid.

2. A dispenser as in claim 1 wherein said rod is a threaded rod along more than half the length thereof, said rod threadedly engaging said viscous liquid holder whereby upon the rotation of said rod said viscous liquid holder can be moved in said barrel.

3. A dispenser as in claim 1 wherein an upper portion of said barrel extension is at an angle to the vertical axis to said barrel.

4. A dispenser as in claim 3 wherein the upper portion of said barrel extension is at an angle of about 5° to 75° to the vertical axis of said barrel.

5. A dispenser as in claim 3 wherein there are at least two conduits extending through said barrel extension for connecting said barrel to a lower portion of said viscous liquid applicator.

6. A dispenser as in claim 1 wherein the viscous liquid applicator has a porous surface, said porous surface of said viscous liquid applicator being a microporous polymeric material.

7. A dispenser as in claim 1 wherein the viscous liquid applicator has a porous surface, said porous surface of said viscous liquid applicator being a woven fabric.

8. A dispenser as in claim 1 wherein the viscous liquid applicator has a porous surface, said porous surface of said viscous liquid applicator being a nonwoven fabric.

9. A dispenser as in claim 8 wherein said nonwoven fabric is an extruded fabric with a plurality of apertures.

10. A dispenser as in claim 1 wherein said actuator has at least one drive arm extending inwardly of said barrel extension, said at least one drive arm contacting said mechanism for rotating said rod.

11. A dispenser as in claim 10 wherein said rod has a plurality of gear teeth around an upper part thereof, said at least one drive arm contacting said plurality of gear teeth and rotating said rod.

12. A dispenser as in claim 11 wherein there is at least one spring arm extending inwardly from said actuator.

13. A dispenser as in claim 1 wherein said viscous liquid applicator has at least one applicator conduit extending from a lower surface thereof, said at least one applicator conduit interconnecting with at least one barrel extension conduit to flow said viscous liquid from said barrel to said liquid applicator.

* * * * *